United States Patent [19]

Smith

[11] Patent Number: 4,704,222

[45] Date of Patent: Nov. 3, 1987

[54] GELLED ABRASIVE DETERGENT COMPOSITION

[75] Inventor: James A. Smith, Chatham, Mass.

[73] Assignee: Noxell Corporation, Hunt Valley, Md.

[21] Appl. No.: 904,331

[22] Filed: Sep. 5, 1986

[51] Int. Cl.[4] ..... C11D 3/14; C11D 3/37

[52] U.S. Cl. ..... 252/106; 252/155; 252/174.23; 252/174.25; 252/545; 252/548; 252/551; 252/553; 252/559; 252/DIG. 2

[58] Field of Search ..... 252/106, 131, 129, 140, 252/155, 174.23, 174.25, 545, 551, 553, 558, DIG. 2, 315.1; 51/298, 308

[56] References Cited

U.S. PATENT DOCUMENTS

| | | | |
|---|---|---|---|
| 3,677,954 | 7/1972 | Nakajima et al. | 252/121 |
| 3,931,089 | 1/1976 | Karl | 524/300 |
| 3,985,668 | 10/1976 | Hartman | 252/99 |
| 4,108,800 | 8/1978 | Froehlich | 252/541 |
| 4,122,025 | 10/1978 | Kiewert et al. | 252/173 |
| 4,240,919 | 12/1980 | Chapman | 252/95 |
| 4,287,079 | 9/1981 | Robinson | 252/99 |
| 4,351,754 | 9/1982 | Dupré | 524/445 |
| 4,396,525 | 8/1983 | Rubin et al. | 252/174.25 |
| 4,397,755 | 8/1983 | Brierley et al. | 252/113 |
| 4,534,892 | 8/1985 | Suzuki et al. | 252/545 |
| 4,537,604 | 8/1985 | Dawson | 51/298 |
| 4,540,510 | 9/1985 | Karl | 252/315.3 |

FOREIGN PATENT DOCUMENTS

| | | |
|---|---|---|
| 6797 | 1/1985 | Japan . |
| 139793 | 7/1985 | Japan . |

OTHER PUBLICATIONS

Rheothik Polysulfonic Acid Technical Bulletin, Henkel Corp. (1983).

*Primary Examiner*—Prince E. Willis

*Attorney, Agent, or Firm*—Merchant, Gould, Smith, Edell, Welter & Schmidt

[57] ABSTRACT

A gelled high-solids aqueous cleaning composition is disclosed which comprises about 25-85% particulate abrasive solids, a minor but effective friction-reducing amount of a polysulfonic acid, about 2-35% of a plurality of gelling agents and about 1-10% of an anionic surfactant.

19 Claims, No Drawings

GELLED ABRASIVE DETERGENT COMPOSITION

BACKGROUND OF THE INVENTION

Abrasive detergent applicators and compositions have been developed to facilitate the removal of tenacious soils such as dried and burned food residues on kitchenware, chemical residues in laboratory equipment, coatings of rust and other corrosion and the like. Abrasive detergent applicators often involve the use of metal or hard plastic sheets or pads which are impregnated with detergents, builder salts and bleaches. However, the detergent reservoirs in these applicators are rapidly depleted and the substrates are themselves subjected to chemical and physical degradation. Furthermore, it is not possible for the user to control the amount of detergent which is applied from the substrate onto the target surface.

Detergent compositions have been disclosed which include varying amounts of particulate abrasive solids, such as powdered minerals. These compositions can be formulated as liquid suspensions or as semi-liquid pastes. Although relatively large amounts of abrasives can be included in such compositions, liquid products are difficult to manually apply in a controlled fashion and both liquid and pasty detergent compositions tend to lack adequate phase stability.

For example, Chapman (U.S. Pat. No. 4,240,919) discloses a thixotropic liquid detergent composition which employs multivalent metal stearate soaps to hold the abrasive particles in suspension. Kiewart et al. (U.S. Pat. No. 4,122,025) discloses pourable or pasty cleaning compositions containing low density cristobalite abrasive particles which allegedly resist settling.

A persistent problem associated with many of these products is that they are overly abrasive. The particulate abrasive particles exhibit a high coeffient of friction, which creates drag, and makes the products difficult to apply. This high coefficient of friction also makes the products difficult to remove from the target surface after use. Furthermore, high-solids abrasive detergent products are generally designed for cleaning kitchenware such as soiled metal pots and pans. In recent years, a wider variety of materials have been used to make cooking utensils, including plastics and specially coated and plated metals. Thus, a need exists for highly abrasive detergents which will effectively clean such utensils without dulling or abrading the surfaces thereof.

Because these properties are somewhat at odds, it is often necessary to limit the amount of abrasive material or to employ mild abrasives in order to avoid such damage. For example, Dawson (U.S. Pat. No. 4,537,604), discloses paste detergent compositions comprising abrasive particles formed by agglomerating mineral particles with organic binders. Although such agglomerates may moderate the abrasive power of the mineral particles included therein, their preparation necessarily complicates the formulation of these detergents, and increases their cost.

From the foregoing, it is clear that a need exists for a high solids detergent composition which is phase stable under a wide range of conditions, and is easy to apply and remove while retaining high cleaning power.

BRIEF DESCRIPTION OF THE INVENTION

The present invention is directed to a high-solids aqueous gelled detergent composition which strongly resists syneresis. The composition may contain as much as about 80–85% by weight of particulate abrasive solids, which are gelled by means of a mixture of about 2–35% of inorganic and organic gelling (thickening) agents. Furthermore, the ease of application, cleaning and removal of the present gels was unexpectedly found to be enhanced by the addition of a minor but effective friction-reducing amount of the anionic polysulfonic acid, poly(2-acrylamido-2-methylpropane)sulfonic acid. Thus, about 0.1–2% of this polysulfonic acid acts as a lubricant for the insoluble components of the present invention, acting to substantially increase their "slip".

To moderate the abrasive action of the particulate abrasive solids, the abrasive particles preferably will comprise a mixture of hard mineral solids (Moh's hardness of about 6–9) and soft mineral solids (Moh's hardness about 0.5–1.0 to 5.5). For example, the particulate abrasive solids can contain about 25–98% of hard mineral solids, which act primarily to break up hardened soils by their scouring action, in combination with about 2–75% of soft mineral solids which primarily act to polish metallic target surfaces.

The abrasive solids are held in a phase-stable gel by means of a mixture of a non-abrasive inorganic gelling agent and an organic gelling agent, such as a mixture of a clay-based thickening agent and an organic polymeric thickener. As defined herein, the term "organic gelling (thickening) agent" does not include the polysulfonic acid component.

The present composition will also comprise about 1–5% of at least one anionic surfactant, which acts to disperse oily or greasy soils. Preferably, the anionic surfactant component will comprise a major proportion of an ammonium or a metal sulfonate salt, which may be combined with a minor amount of an ammonium or a metal sulfate salt. Optionally, the present gels will comprise a minor but effective amount of a foam-forming nonionic surfactant such as a fatty acid alkanolamide, along with minor but effective amounts of antimicrobial agent, dye and/or fragrance.

For example, one embodiment of the present aqueous gelled detergent composition comprises by weight:

(a) about 25–85% particulate abrasive solids;
(b) a minor but effective friction-reducing amount of poly[2-acrylamido-2-methylpropane]sulfonic acid;
(c) about 1–15% of an inorganic gelling agent;
(d) about 1–8% of an organic gelling agent;
(e) about 1–5% of an anionic surfactant; and
(f) the balance water.

When formulated in the proportions given hereinabove, these ingredients yield a smooth, homogeneous gel which is highly resistant to syneresis, or phase separation. The gel can readily be applied to soiled surfaces in a controlled fashion, via a moistened applicator pad, where it scours away hardened soils and removes grease without undue abrasion. The residue comprising the loosened soils are readily rinsed from the cleaned surface.

All ingredient percentages given herein are weight percentages of active ingredients. For example, the weight percentages of polymers and surfactants do not include the water which may be present in the commercially-available forms of these ingredients. The hardness of the mineral components is given in accord with Moh's Scale of Hardness [Handbook of Chemistry, N. A. Lange, ed., McGraw-Hill, New York (1961) at pages 150–207, the disclosure of which is incorporated by reference herein]. Surfactant nomenclature is in accord with *The CTFA Cosmetic Ingredient Dictionary,* N. F. Estrin et al., eds. (3rd ed. 1982).

DETAILED DESCRIPTION OF THE INVENTION

Abrasives

The choice of abrasive material may be made from a wide variety of materials of adequate hardness and of a particle size range which will enable them to effectively scour soiled surfaces while remaining homogeneously dispersed throughout the aqueous phase of the gel during preparation and storage. Preferably, the present compositions will contain at least about 25–30% by weight of total abrasive solids and can include up to about 75–85% abrasive solids. Preferably, the abrasive solids will comprise a mixture of hard mineral solids (hardness: 6–9)) and soft mineral solids (hardness: 0.5–1 to 5–5.5) in order to introduce both a scouring and a polishing factor into the gels.

For example, about 25–98% of the total abrasive solids can be made up of hard mineral particles such as powdered quartz, sand, feldspar, zircon, corundum and the like. A preferred hard mineral abrasive for use in the present invention is F-4 Feldspar (170–200 mesh) available from International Minerals and Chemical Corp., Mundelein, IL.

Soft mineral abrasives useful in the present invention include gypsum, calcite, fluorite, cryolite, apatite, kaolinite clays, e.g., kaolin, kaolinite, anauxite, metakaolinite and the like. About 2–75% of the total abrasive solids can include these mineral abrasives. For example, about 3–60% of the total abrasive solids can be made up of Kaopolite TM 1168, an anhydrous aluminum silicate (kaolin) available from Kaopolite, Inc. Union, N.J. (1.8 micron average particle size).

Gelling Agent

The insoluble abrasive solids are suspended in an aqueous phase which is gelled with a combination of an inorganic and an organic gelling (thickening) agent. For example, a mixture of about 2–10% of an inorganic gelling agent and about 2–7% of an organic gelling agent are effective to gel a composition of the present invention which comprises about 15–35% water and about 40–75% abrasive solids.

Preferably, the inorganic gelling agents employed will comprise those of natural or synthetic of mineral origin. Preferred gelling agents are the montomorillonite clays such as the saponites, hectorites, laponites and the montmorillonite colloidal clays such as Veegum TM (Vanderbilt Minerals, Murray, KY) or Magnabrite TM (American Celloid Co., Skokie, IL). Clay-based gellants containing montmorillonite and aluminum hydrosilicate together with suborganic radicals are available as the Tixogel TM series (United Catalysts, Louisville, KY). An especially-preferred montmorillonite clay gelling agent is a bentonite such as Korthix TM H (Kaopolite, Inc., Union, NJ). Inosilicates can also be used, alone or in combination with the clays. Preferred inosilicates are the naturally-occurcing calcium metasilicates such as wollastonite, available as the NYAD TM wollastonite series (Processed Minerals Inc., Willsboro, NY). Synthetic sodium magnesium silicate clays and fumed silicas can also be used as gelling agents.

Organic gelling agents useful in the practice of the present invention include carboxymethycellulose, polyvinylpyrrolidone and polymeric organic waxes. The useful polymeric waxes include ethylene acrylate copolymers, ethylene acrylic acid copolymers and polyethylene (e.g., oxidized polyethylenes). These materials are commercially available in the form of aqueous emulsions or dispersions, e.g., from Allied Chemical, Morristown, NJ, as the A-C Copolymer and A-C Polyethylene series, such as A-C Copolymer 540, A-C Copolymer 580 and A-C Polyethylene 617 and 629. Waxy polyethylene glycols (PEG) such as those of a molecular weight of about 800 to 1700–2000 are preferred for use in the present gels. For example, about 1–8% of PEG 1000 affords smooth, stable gels, particularly when employed in combination with about 2–10% of a clay-based gelling agent such as bentonite.

The Polysulfonic Acid

The gelled detergents of the present invention will comprise a minor but effective amount of an anionic polysulfonic acid: poly(2-acrylamido-2-methylpropane) sulfonic acid which incorporates repeating units of the general formula: $[—CH_2CH(CONHCMe_2CH_2SO_3^-H^+)—]$.

This polymer is commercially available as Rheothik TM Polymer 80–11 from the Henkel Corp., Hoboken, NJ, which is a 14–17% aqueous solution of the polysulfonic acid (pH 0.5–1.0; $2\times10^5$ cps viscosity, molecular weight $=1\text{-}2\times10^6$). In the present high-solids gels, a small amount of this polymer (about 0.05–5%) acts as a lubricant for the particulate abrasives and insoluble thickeners, reducing the energy output needed to rub the gel over the target surface and facilitating the complete removal of the product residue from the cleaned surface.

Anionic Surfactant

Preferably, the present compositions will include an amount of one or more anionic surfactants effective to disperse oily or greasy soils. Due to the anionic nature of the polysulfonic acid component, cationic surfactants are not employed in the present compositions.

Useful anionic surfactants include the ammonium and alkali metal salts of sulfated ethylenoxy fatty alcohols (the sodium or ammonium sulfates of the condensation products of about 1–4 moles of ethylene oxide with a $C_8$–$C_{22}$ fatty alcohol, such as a $C_{12}$–$C_{15}$ n-alkanol, i.e., the Neodol TM ethoxysulfates, such as Neodol TM 25.35, Shell Chemical Co.; n-$C_{12}$–$C_{15}$-alkyl(OEt)$_3$OSO$_3$Na; anionic detergent salts having alkyl substituents of 8 to 22 carbon atoms such as the water-soluble higher fatty acid alkali metal soaps, e.g., sodium myristate and sodium palmitate.

Another useful class of anionic surfactants encompasses the water-soluble sulfated and sulfonated anionic ammonium, alkali metal and alkaline earth metal detergent salts containing a hydrophobic higher alkyl moiety (typically containing from about 1 to 22 carbon atoms) such as salts of alkyl mono or polynuclear aryl sulfonates having from about 1 to 16 carbon atoms in the alkyl group (e.g., sodium toluene sulfonate, sodium xylene sulfonate, sodium dodecylbenzenesulfonate, magnesium tridecylbenzenesulfonate, lithium or potassium pentapropylenebenzenesulfonate). These compounds are available as Nacconol TM 35 SL (Stephan Chemical Co., Northfield, IL, sodium dodecylbenzene sulfonate) or as Stephanate TM X (sodium xylene sulfonate) or Stephanate TM AM (ammonium xylene sulfonate, Stephen Chemical Co.). The alkali metal salts of alkyl napthalene sulfonic acids (methyl napthalene sulfonates) are available as Petro TM AA, Petrochemical Corporation.

Also useful are the sulfated higher fatty acid monoglycerides such as the sodium salt of the sulfated monoglyceride of coconut oil fatty acids and the potassium salt of the sulfated monoglyceride of tallow fatty acids; alkali metal salts of sulfated fatty alcohols containing from about 10 to 18 carbon atoms (e.g., sodium lauryl sulfate and sodium stearyl sulfate); sodium $C_{14}$–$C_{16}$-alpha-olefin sulfonates such as the Bio-Terge TM series (Stephen Chemical Co.); alkali metal salts of higher fatty esters of low molecular weight alkylol sulfonic acids, e.g., fatty acid esters of the sodium salt of isethionic acid; the fatty ethanolamide sulfates; the fatty acid amides of amino alkyl sulfonic acids, e.g., lauric acid amide of taurine and the alkali metal salts of sulfosuccinic acid esters, e.g., dioctyl sodium sulfosuccinate (Monawet TM series, Mona Industries, , Inc., Patterson, NJ).

Preferably, the anionic surfactant component will comprise a mixture of an anionic sulfate or sulfonate surfactant, most preferably, a major proportion of an ammonium or alkali metal sulfonate will be employed, optionally in combination with an ammonium or alkali metal salt of a sulfate. Preferred sulfonate salts include the alkylaryl sulfonates, and preferred sulfates include sulfated polyethylene glycol ethers of fatty alcohols, wherein the ratio of the sulfonate salt to the sulfated fatty alcohol is about 5–15:1.

Nonionic Surfactant

The present gelled detergent composition can optionally employ a minor amount of a nonionic detergent which is effective to foam the gel during the cleaning process. Such surfactants include fatty acid amides such as the mono-and dialkanolamides of $C_8$–$C_{22}$ fatty acids, e.g., a mono- or di($C_2$–$C_4$)alkanol-amide. Commerically-available nonionic surfactants of this class include lauramide DEA (Standamid TM LP, Henkel), lauramide MEA (Monamid TM LMA, Mona), lauramide MIPA (Monamid TM LIPA, Mona), myrisamide MEA, myristamide MIPA, myristamide DEA, oleamide DEA, oleamide MEA, oleamide MIPA, cocamide MEA, cocamide DEA, cocamide MIPA, stearamide MEA, stearamide MIPA, stearamide DEA and the like.

Other useful foam-producing nonionic surfactants include the amine oxides, such as the $C_{10}$–$C_{20}$-alkyl-di (lower)alkyl-amine oxides or the [$C_{10}$–$C_{20}$-alkylamido ($C_2$–$C_5$)alkyl]di(lower)alkyl-amine oxides. Especially preferred members of this class include lauryl(dimethyl) amine oxide, myristyl(dimethyl)amine oxide, stearyl (dimethyl)amine oxide (Schercamox TM DMS, Scher Chemicals, Inc., Clifton, NJ); coco(bis-hydroxyethyl)amine oxide (Schercamox TM CMS), tallow(bis-hydroxyethyl)amine oxide and cocoamidopropyl(dimethyl)amine oxide (Schercamox(T) C-AA).

Antimicrobial Agent

Minor but effective amounts of chemically-compatible antimicrobial agents may also be included in the present gels to reduce or eliminate the bioburden of the gel during storage and following exposure to air.

A wide variety of antimicrobial agents or biocides may be included in effective amounts without inducing undesirable interactions or chemical reactions between the major components of the composition. Such agents include chlorhexidine gluconate, glutaral, halazone, hexachlorophene, hydantoin derivatives, nitrofurazone, nitromersol, thimerosal, $C_1$–$C_5$-parabens, clofucarban, chlorophene, poloxamer-iodine, phenolics, mefanide acetate, aminacrine hydrochloride, oxychlorosene, metabromsalene, merbromine, dibromsalan and the like.

The amount of any given antimicrobial agent or mixture thereof included in the present gels will be dependent upon its potency and stability, but generally will not exceed about 1.0% by weight of the finished composition.

Fragrance

Minor but effective amounts of fragrance selected so as to be chemically-compatible with the above-described ingredients are preferably included in the compositions of the present invention for cosmetic purposes. Useful fragrances will include, for instance, about 0.025–2% preferably about 0.05–1.5% of floral oils such as rose oil, lilac, jasmine, wisteria, apple blossom or compound bouquets such as spice, aldehydic, woody, oriental and the like.

Therefore, the gelled detergent composition of the present invention will comprise by weight about 25–85%, preferably about 40–75% particulate abrasive solids, wherein said abrasive solids include about 25–98%, preferably about 30–95% hard mineral solids having a Moh's Hardness of about 6–9 and about 2.0–75%, preferably about 3–60% soft mineral solids having a Moh's Hardness of about 0.5–5.5. The weight ratio of the hard mineral solids to soft mineral solids can be about 2–50:1, most preferably about 10–20:1. Preferably, the hard mineral solids will comprise a major proportion of feldspar and the soft mineral solids will comprise a clay-based polishing agent such as Kaolin.

The present compositions will also comprise about 1–15%, preferably about 2–10%, of an inorganic gelling agent such as a non-abrasive clay, and about 1–8% of an organic thickening agent, preferably about 2–7% of a waxy polyethylene glycol, e.g., PEG 1000; about 0.05–5%, preferably about 0.1–2% of poly (2-acrylamido-2-methylpropane)sulfonic acid, about 1–10% of an anionic surfactant, preferably about 2.0–7.5% of a sulfate or sulfonate surfactant, and the balance water, preferably about 15–35% water, most preferably about 20–30% water, including the aqueous fraction of the surfactants, polymers and the like.

Optionally, about 0.1–2% of a foam-producing nonionic detergent such as a fatty acid diethanol amide may also be included in the present gels, along with minor but effective amounts of fragrance, dye, biocide, and alkanization agents such as sodium silicate.

Preparation

The ingredients described hereinabove can be combined to yield the present gelled detergents by adding them to an amount of water equal to about 70–90% of the total water, the remainder of the water being provided by the free water present in the polysulfonic acid and the surfactants. For example, the water is heated to about 25°–35° C. with agitation, and the organic gellant is added, followed by the polysulfonic acid, the anionic sulfonate, the nonionic surfactant and the preservative. The pH is adjusted to neutrality (about 7.0–7.5). The stirred mixture is heated to about 55°–60° C. for about 15 min. to one hour, then cooled to about 35°–45° C. The anionic sulfate surfactant is then added, followed by the abrasives and the inorganic gelling agent, with reduced agitation. The fragrance and dye, if any, can be added at this point and mixing is continued until a uniform, thick gel results.

The finished product is stored in wide-mouthed, sealed containers. In use, the desired amount of detergent gel is removed from the container, e.g., by contacting it with a moistened sponge, and is manually applied to the soiled surface. Following the cleaning step, the residue is rinsed away with water, leaving the target surface clean and free of grease. In the case of metal surfaces, a polishing effect is also observed.

The invention will be further described by reference to the following detailed example.

EXAMPLE

Gelled Detergent Composition

Deionized water (149 ml) was placed in a 1.0 liter beaker equipped with a variable speed turbine blade stirrer. The water was heated in 30° C. with stirring and 30.0 g of polyethylene glycol (Carbowax TM 1000, Union Carbide Corp., Danbury, CT) was added, followed by 40 g of a 15% aqueous solution of poly(2-acryamido-2-methylpropane) sulfonic acid (Rheothik Polymer TM 80-11, Henkel Corp.), 79 g of sodium dodecylbenzene sulfonate (Nacconol TM 35 SL, Stephan Chemical Co., Northfield, IL) 5.0 g of lauramide DEA (lauroyl bis(2-hydroxyethyl) amide, Standamid TM LD, Henkel Corp.), 6.8 g of a hydantoin preservative and 2.0 g of sodium metasilicate. The reaction mixture, which exhibited a pH of 7.25, was heated to about 55°-60° C. for 30 min. then cooled to 40° C. with continued stirring. $(C_{12}-C_{15})$-n-alkyl(OEt)$_3$OSO$_3$Na (Neodol TM 25-3S, Shell Chemical Co., 5.2 g) was then added, followed by 570 g ot 200 mesh feldspar, 55.0 g of kaolin (Kaopolite TM 1168, Kaopolite, Inc., Elizabeth, NJ) and 45.0 g of bentonite thickener (Korthix TM H, Kaopolite, Inc.), with slow agitation to avoid air entrapment. Fragrance (3.0 g, Alpine No. 135-994) was added, followed by 0.1 g of blue dye.

Stirring was continued for 45 minutes to yield 1000 g of a thick, creamy blue-gray gel. When filled into 6.5×5.5 cm glass jars, the gel exhibited no syneresis after one year, despite repeated periods of exposure to air. When manually applied to a variety of soiled metal or enamel surfaces with a sponge pad, the gel was effective to clean the surfaces without scratching or dulling them.

The invention has been described with reference to various specific and preferred embodiments and techniques. However, it should be understood that many variations and modifications may be made while remaining within the spirit and scope of the invention.

What is claimed:

1. A detergent composition comprising a gel incorporating:
   (a) about 25-85% particulate abrasive solids;
   (b) a minor but effective friction-reducing amount of poly[2-acrylamido-2-methylpropanesulfonic acid] having a molecular weight of about $1-2\times10^6$;
   (c) about 1-15% of a non-abrasive inorganic gelling agent;
   (d) about 1-8% of an organic gelling agent which does not include said sulfonic acid;
   (e) about 1-10% of an anionic surfactant; and
   (f) the balance water.

2. The detergent composition of claim 1 wherein the abrasive solids comprise a mixture of hard mineral solids having a hardness of about 6-6.5 and soft mineral solids having a hardness of about 1.0-5.5.

3. The detergent composition of claim 2 wherein the ratio of hard mineral solids to soft mineral solids is about 2-50:1.

4. The detergent composition of claim 1 wherein the inorganic gelling agent is a clay-based gelling agent.

5. The detergent composition of claim 1 wherein the organic gelling agent comprises a waxy polyethylene glycol.

6. The detergent composition of claim 1 wherein the anionic surfactant comprises a major proportion of an ammonium or an alkali metal sulfonate.

7. The detergent composition of claim 1 which comprises about 15-35% water.

8. The detergent composition comprising a gel incorporating:
   (a) about 30-75% particulate abrasive solids comprising
      (i) about 25-98% of mineral solids having a hardness of about 6-9 and
      (ii) about 2-75% of mineral solids having a hardness of about 0.5-5.5;
   (b) about 0.05-5% of poly[2-acrylamido-2-methylpropenesulfonic, acid] having a molecular weight of about 1-2×106;
   (c) about 2-10% of a non-abrasive clay gelling agent;
   (d) about 2-7% of a waxy polyethylene glycol;
   (e) about 2-7% of an anionic sulfate or sulfonate surfactant; and
   (f) the balance water.

9. The detergent composition of claim 1 wherein the mineral solids having a hardness of about 0.5-5.5 comprise kaolin.

10. The detergent composition of claim 8 wherein the polyethylene glycol comprises a polyethylene glycol of molecular weight 800-2000.

11. The detergent composition of claim 8 wherein the anionic detergent comprises a major proportion of an alkylaryl sulfonate.

12. The detergent composition of claim 8 wherein the anionic detergent comprises a sulfated polyethylene glycol ether of a fatty alcohol.

13. The detergent composition of claim 8 which further comprises about 0.1-2% of a monoalkanolamide of a dialkanolamide of a fatty acid.

14. A detergent composition comprising a gel consisting essentially of:
   (a) about 40-75% particulate abrasive solids including
      (i) about 30-95% 170-200 mesh feldspar and
      (ii) about 3-60% kaolin;
   (b) about 0.1-2% of poly[2-acrylamido-2-methylpropanesulfonic acid] having a molecular weight of about $1-2\times10^6$;
   (c) about 2-10% bentonite;
   (d) about 1-8% polyethylene glycol having a molecular weight of about 800-1700;
   (e) about 1-5% of an anionic surfactant; and
   (f) about 20-30% water.

15. The detergent composition of claim 14 which further comprises a monoethanolamide or a diethanolamide of a $C_8-C_{22}$-fatty acid.

16. The detergent composition of claim 14 wherein the anionic surfactant comprises a major amount of a $(C_1-C_{15})$alkylaryl sulfonate salt.

17. The detergent composition of claim 16 wherein the anionic surfactant further comprises a sulfated polyethylene glycol ether of a $C_8-C_{22}$ fatty alcohol.

18. The detergent composition of claim 17 wherein the ratio of the sulfonate salt to the sulfated fatty alcohol is about 5-15:1.

19. The detergent composition of claim 14 which includes a minor but effective amount of an antimicrobial agent.

* * * * *

UNITED STATES PATENT AND TRADEMARK OFFICE

CERTIFICATE OF CORRECTION

PATENT NO. : 4,704,222

DATED : November 3, 1987

INVENTOR(S) : James A. Smith

It is certified that error appears in the above-identified patent and that said Letters Patent is hereby corrected as shown below:

At Col. 3, line 49, for "the montomorillonite clays" read --the montmorillonite clays--.

At Col. 4, line 22, for "[$-CH_2CH(CONHCMe_2CH_2SO_3^-H^+)-$]." read --[$-CH_2CH(CONHCMe_2CH_2SO_3^-H^+)-$].--.

At Col. 4, line 48, for "25.35, Shell Chemical" read --25-3S, Shell Chemical--.

At Col. 4, line 48, for "n-$C_{12}$-$C_{15}$-alkyl(OEt)-$_3OSO_3Na$;" read --n-$C_{12}$-$C_{15}$-alkyl$(OEt)_3OSO_3Na$;--.

At Col. 5, line 57, for "(Schercamox(T)C-AA)." read --(Schercamox™C-AA).--.

At Col. 6, line 34, for "such as Kaolin." read --such as kaolin.--.

At Col. 7, line 22, for "acryamido-2-methylpropane) sulfonic acid" read --acrylamido-2-methylpropane)sulfonic acid--.

At Col. 7, line 31, for "($C_{12}$-$C_{15}$)-n-alkyl(OEt)-$_3OSO_3Na$" read --($C_{12}$-$C_{15}$)-n-alkyl$(OEt)_3OSO_3Na$--.

UNITED STATES PATENT AND TRADEMARK OFFICE

CERTIFICATE OF CORRECTION

PATENT NO. : 4,704,222

DATED : November 3, 1987

INVENTOR(S) : James A. Smith

It is certified that error appears in the above-identified patent and that said Letters Patent is hereby corrected as shown below:

At Col. 8, line 22, claim 8, for "1-2x106;" read --$1\text{-}2\text{x}10^6$;--.

Signed and Sealed this

Twenty-first Day of June, 1988

*Attest:*

DONALD J. QUIGG

*Attesting Officer*

*Commissioner of Patents and Trademarks*